United States Patent [19]

Samuels

[11] 3,947,040

[45] Mar. 30, 1976

[54] INSTRUCTIONAL INDICIA CARRYING MEMBER FOR CHESS PIECE

[75] Inventor: Harold Samuels, Locust Valley, N.Y.

[73] Assignee: Adult Leisure Products Corporation, Locust Valley, N.Y.

[22] Filed: July 29, 1974

[21] Appl. No.: 492,511

[52] U.S. Cl. ..... 273/137 R

[51] Int. Cl.[2] ..... A63F 3/02

[58] Field of Search ..... 273/137 R; 40/306, 310

[56] References Cited

UNITED STATES PATENTS

| | | | |
|---|---|---|---|
| 1,472,657 | 10/1923 | Lillard | 273/137 R |
| 1,853,622 | 4/1932 | Kennedy | 40/310 UX |
| 3,856,309 | 12/1974 | Helfgott | 273/137 R |

FOREIGN PATENTS OR APPLICATIONS

| | | | |
|---|---|---|---|
| 1,034,030 | 6/1966 | United Kingdom | 273/137 R |
| 17,898 | 11/1898 | Switzerland | 273/137 R |

OTHER PUBLICATIONS

Catalog, Selchow and Righter, Bayshore, N.Y., rec'd 3/14/68, p. 18.

*Primary Examiner*—Anton O. Oechsle

[57] ABSTRACT

An indicia carrying member for use in combination with a chess piece is provided comprising an element having an indicia bearing surface. The element is removably mounted on the chess piece such that the surface extends outwardly beyond the peripheral confines of the piece to form a skirt-like appendage. After the member is mounted on the piece, substantially all of the indicia bearing surface is visible when the piece is viewed from above. The member may be mounted to the chess piece by means of an opening in the member adopted to engage a recess in the base of the chess piece or may be affixed to the underside of the chess piece by means of a pressure sensitive adhesive. The indicia on the element may include the name of the piece, a diagrammatical representation of the permissible moves of the piece, the symbol of the piece in chess notation and the comparative numerical value of the piece.

3 Claims, 5 Drawing Figures

FIG. 1
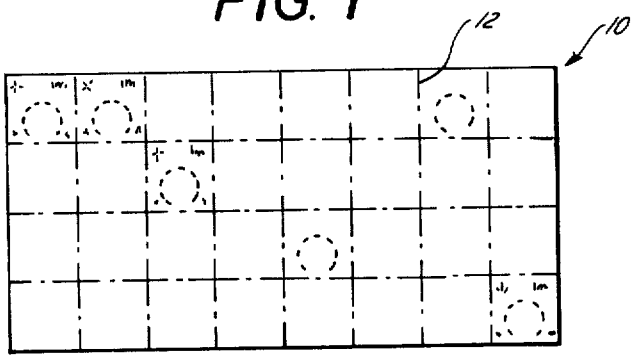
FIG. 3
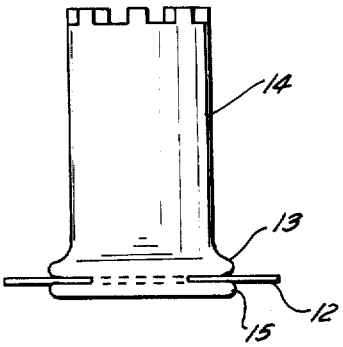
FIG. 2
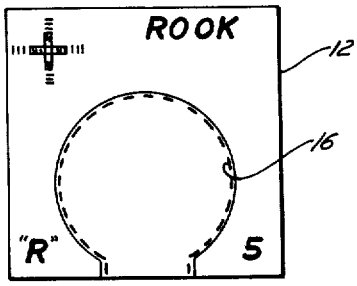
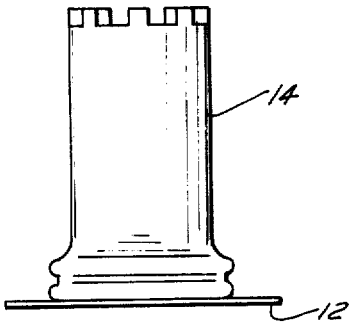
FIG. 5
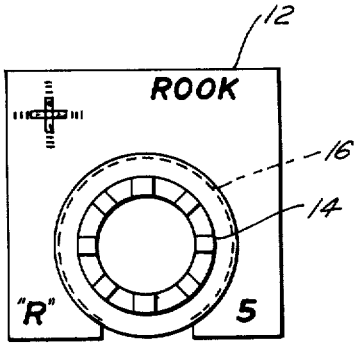
FIG. 4

INSTRUCTIONAL INDICIA CARRYING MEMBER FOR CHESS PIECE

The present invention relates to a device for use in learning the game of chess and, in particular, to an instructional indicia carrying member which can be removably mounted on a chess piece such that pertinent information concerning the chess piece is readily visible to the player.

The game of chess has been played throughout the world since the Middle Ages by experts and novices alike. To those skilled in the art of the game of chess, the various permissible moves of the different chess pieces are well known. However, to those learning the game of chess, the names of the individual chess pieces, the permissible moves thereof and the relative value of the pieces is confusing and complicated.

In order to learn the mechanics of chess many have resorted to instruction sheets or books, or verbal explanations which, because of the variety of different permissible moves and the unfamiliar terminology, require a great deal of concentration and effort on the part of the learner. One of the reasons for this difficulty in learning the mechanics of the game is the lack of visual reinforcement of the pertinent information during the actual playing of the game.

It is, therefore, a prime object of the present invention to provide an indicia carrying member which may be removably mounted to the chess piece which is readily visible during the game and which carries thereon pertinent information concerning the piece.

It is another object of the present invention to provide an indicia carrying member for use with a chess piece which, when mounted on the chess piece, extends outwardly beyond the peripheral confines of the piece to form a skirtlike appendage wherein substantially all of the indicia bearing surface is visible when the piece is viewed from above.

It is another object of the present invention to provide an indicia carrying member for use with a chess piece which can be mounted to the base of the chess piece during the learning period and thereafter removed after the player has obtained sufficient skill to play without the learning aid.

It is a further object of the present invention to provide an indicia carrying member to be used with a chess piece wherein the indicia includes the name of the piece, a diagrammatical representation of the permissible moves of the piece, the symbol of the piece in chess notation, and the comparatrive numerical value of the piece.

In accordance with the present invention, an indicia carrying member is provided for use with a chess piece. The member comprises an element having an indicia bearing surface. The element is removably mounted on the chess piece in a manner such that the element extends outwardly beyond the peripheral confines of the chess piece to form a skirt-like appendage for the piece. When so mounted, substantially all of the indicia bearing surface is visible when the piece is viewed from above.

Preferably, the indicia carrying member has a substantially square configuration which is approximately the same size as a square on a conventional chess board. This aids in the location of the pieces on the board as well as tending to keep the pieces separated so that the pieces and the indicia carrying members can be easily seen. Further, the members do not interfere with the other pieces on the board as each piece having a member mounted thereon which is properly positioned on the board takes up only a single square on the board.

In a first embodiment, the indicia carrying member has an opening therein which is adopted to engage a recess present in the base of a conventional chess piece. In a second embodiment, a portion of the indicia carrying member is adopted to be affixed to the underside of the base of the chess piece by means of a pressure sensitive adhesive.

The indicia carrying member has indicia thereon which may comprise the name of the piece, a diagrammatical representation of the permissible moves of the piece, the symbol of the piece in chess notation and the comparative numerical value of the piece. These indicia are readily visible to the player during the game such that the mechanical aspects of the game are easily ascertainable. After the player has become acquainted with the information on the member and no longer needs the learning aid, the indicia carrying member is removed from the chess piece and the pieces then comprise a conventional chess set.

To these and other objects as they may hereinafter appear, the present invention is an indicia carrying member for use with a chess piece as defined by the appended claims and as described in the specification, taken together with the accompanying drawings wherein like numerals refer to like parts and in which:

FIG. 1 is a top elevational view of a set of thirty-two of the indicia carrying members of the present invention detachably secured together in card-like form;

FIG. 2 is a top elevational view showing in greater detail one of the indicia carrying members of FIG. 1;

FIG. 3 is a side elevational view of a chess piece having a first embodiment of the indicia carrying member of the present invention mounted thereon;

FIG. 4 is a top elevational view of the chess piece and indicia carrying member of FIG. 3; and FIG. 5 is a side elevational view of a chess piece and a second embodiment of the indicia carrying member of the present invention.

The present invention consists of an indicia carrying member for use in combination with a conventional chess piece. The member carries indicia containing information concerning the mechanics of playing chess. Thirty-two such members make up a complete set, one for each of the thirty-two pieces in a chess set. Preferably, the members are made up of paper or thin cardboard, however, other materials such as plastic may also be utilized. The instructional indicia are placed on the upper surface of the members either by imprinting the information directly on the member or by affixing the indicia to the upper surface of the member by some other means such as by a label or decal.

Although the individual indicia carrying members may be manufactured separately, it is preferable, from a production standpoint, to manufacture all thirty-two of the indicia carrying members in a single step in the form of a card or sheet. The card or sheet is then perforated along the peripheries of each of the members so that the members can be easily detached from the card or sheet by the player prior to mounting on the chess piece. FIG. 1 shows such a card or sheet, generally designated 10. Card 10 is divided into thirty-two sections, each of which corresponds to one of the thirty-two pieces in the chess set. Each of the sections forms one of the indicia carrying members. A set of perforations 12 is created along the lines adjoining adjacent members such that the members can be easily detached from one another.

As can be best seen from FIG. 2, each of the indicia carrying members has a substantially square configuration which is preferably approximately the same size as a square on a conventional chess board. The particular member shown in FIG. 2 is designed for use on a Rook and, therefore, the word "Rook" appears in the upper righthand corner thereof as one of the instructional indicia on the member. In the upper lefthand corner is a diagrammatical representation of the possible moves of the Rook. In the lower lefthand corner is the symbol of the piece in chess notation, in this case, "R". In the lower righthand corner is the comparative numerical value of the Rook, in this case, five points.

The indicia carrying member illustrated in FIG. 2 is shown having indicia which are representative of the type of indicia which may be placed on the member. The particular written material involved herein forms no part of the present invention and other indicia may be used if desired. The indicia used herein for illustrative purposes have been selected to convey as much information as possible concerning the mechanics of the movement of the particular piece to which it is to be mounted and still be readily visible at a glance.

FIGS. 3 and 5 illustrate the first and second preferred embodiments of the present invention, respectively. FIG. 3 shows a chess piece 14, in this case, a Rook. A conventional chess piece has a base thereon with two flanges 13, 15 separated by a recessed portion. An opening 16 is formed in the body of the member which is approximately equal in the size to the circumference of the chess piece at the recess. This opening 16 may be formed in the member by perforating the member as shown in FIG. 2 such that when a member is moved from card 10 the player can separate the perforated portion 16 from the remainder of the body of the member thereby forming an opening therein of appropriate size. Subsequent to the formation of the opening, the member is placed around the base of the chess piece 14 such that the opening 16 engages the recess in the base.

When mounted in this way the member extends outwardly beyond the peripheral confines of the chess piece to form a skirt-like appendage for the piece. As shown in FIG. 4, when the member is mounted to the piece in this manner, substantially all of the indicia bearing surface is visible when the piece is viewed from above, thus permitting both players to see the indicia on all the members. This includes the members on the player's pieces as well as the members on the opponent's pieces. In this manner, the player is made aware of both the possible offensive moves and the possible defensive moves which may take place.

FIG. 5 shows a second preferred embodiment of the present invention wherein opening 16 is not present and the central portion of the members is not perforated. In this embodiment, a pressure sensitive adhesive is used to affix the member to the underside of the base of the chess piece. The pressure sensitive adhesive may be coated on the area opening 16 of the previous embodiment when the card is produced and thereafter covered by a protective covering (not shown) which is peeled off prior to mounting the member on the chess piece. As an alternative, a tube of pressure sensitive adhesive may be enclosed with the card such that the player deposits the adhesive in the central area of the member and then affixes the member to the underside of the base of the piece as shown in FIG. 5.

Thus, the present invention is a simple, inexpensive learning aid for use in mastering the mechanics of playing chess. The indicia affixed thereto apprise the player of certain information relative to the particular piece in question and the structure of the member is such that the information is readily available to the player during the game. This is true of not only players' pieces but also his opponents' pieces such that both offensive and potential defensive moves can be considered. After the player has mastered the mechanics of the game and no longer requires the learning aid, the members may be easily detached from the chess pieces such that the chess set becomes a conventional chess set which can be used and enjoyed by the player.

Although only two embodiments of the present invention have been specifically disclosed herein for purposes of illustration, it is apparent that many modifications and variations may be made upon the specific structures disclosed. It is intented to cover all of these variations and modifications which fall within the scope of this invention as defined by the appended claims.

I claim:

1. In combination, a chess piece having a base with a bottom surface and an annular recess; and an indicia carrying member comprising an element having an indicia bearing surface, means for removably mounting said element within said recess such that said indicia bearing surface extends outwardly beyond the peripheral confines of said recess and substantially parallel to the bottom surface of said base to form a skirt-like appendage for said piece, substantially all of said surface being visible when the piece is viewed from above.

2. The member of claim 1 wherein said mounting means comprises an opened sided aperture within said element of substantially the same size as the inner portion of said annular recess.

3. The member of claim 1 wherein said member has a substantially square configuration.

* * * * *